US011581005B2

(12) United States Patent
Kokkinis et al.

(10) Patent No.: US 11,581,005 B2
(45) **Date of Patent: *Feb. 14, 2023**

(54) METHODS AND SYSTEMS FOR IMPROVED SIGNAL DECOMPOSITION

(71) Applicant: Meta Platforms Technologies, LLC, Menlo Park, CA (US)

(72) Inventors: Elias Kokkinis, Patras (GR); Alexandros Tsilfidis, Athens (GR)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/587,598

(22) Filed: Jan. 28, 2022

(65) Prior Publication Data

US 2022/0148612 A1 May 12, 2022

Related U.S. Application Data

(63) Continuation of application No. 16/521,844, filed on Jul. 25, 2019, now Pat. No. 11,238,881, which is a continuation of application No. 15/804,675, filed on Nov. 6, 2017, now Pat. No. 10,366,705, which is a continuation of application No. 14/011,981, filed on Aug. 28, 2013, now Pat. No. 9,812,150.

(51) Int. Cl.

| | |
|---|---|
| ***G10L 21/02*** | (2013.01) |
| ***G10L 21/0208*** | (2013.01) |
| ***G10L 21/0272*** | (2013.01) |
| ***G10L 19/008*** | (2013.01) |

(52) U.S. Cl.
CPC ..... *G10L 21/0272* (2013.01); *G10L 19/008* (2013.01); *G10L 21/02* (2013.01); *G10L 21/0208* (2013.01)

(58) Field of Classification Search
CPC .. G10L 21/02; G10L 21/0272; G10L 21/0208
See application file for complete search history.

(56) References Cited

U.S. PATENT DOCUMENTS

| | | | |
|---|---|---|---|
| 5,490,516 | A | 2/1996 | Hutson |
| 6,263,312 | B1 | 7/2001 | Kolesnik et al. |
| 6,301,365 | B1 | 10/2001 | Yamada et al. |
| 6,393,198 | B1 | 5/2002 | LaMacchia |

(Continued)

FOREIGN PATENT DOCUMENTS

WO WO 2013/030134 3/2013

OTHER PUBLICATIONS

Cichocki, Andrzej et al. "Nonnegative Matrix and Tensor Factorizations: Applications to Exploratory Multi-Way Data Analysis and Blind Source Separation" Chapter, 1, Sections 1.4.3 and 1.5; John Wiley & Sons, 2009.

(Continued)

*Primary Examiner* — Bryan S Blankenagel
(74) *Attorney, Agent, or Firm* — Fenwick & West LLP

(57) ABSTRACT

A method for improving decomposition of digital signals using training sequences is presented. A method for improving decomposition of digital signals using initialization is also provided. A method for sorting digital signals using frames based upon energy content in the frame is further presented. A method for utilizing user input for combining parts of a decomposed signal is also presented.

19 Claims, 6 Drawing Sheets

(56) References Cited

U.S. PATENT DOCUMENTS

| | | | |
|---|---|---|---|
| 6,542,869 | B1 | 4/2003 | Foote |
| 6,606,600 | B1 | 8/2003 | Murgia et al. |
| 8,103,005 | B2 | 1/2012 | Goodwin et al. |
| 8,130,864 | B1 | 3/2012 | Lee et al. |
| 8,380,331 | B1 | 2/2013 | Smaragdis et al. |
| 9,230,558 | B2 | 6/2016 | Disch et al. |
| 9,363,598 | B1 | 6/2016 | Yang |
| 9,584,940 | B2 | 2/2017 | Tsilfidis et al. |
| 9,812,150 | B2 | 11/2017 | Kokkinis et al. |
| 9,918,174 | B2 | 3/2018 | Tsilfidis et al. |
| 10,262,680 | B2 * | 4/2019 | Mysore ..... G10L 15/20 |
| 10,366,705 | B2 | 7/2019 | Kokkinis et al. |
| 10,468,036 | B2 | 11/2019 | Tsilfidis et al. |
| 11,238,881 | B2 | 2/2022 | Kokkinis et al. |
| 2003/0078024 | A1 | 4/2003 | Magee et al. |
| 2003/0191638 | A1 | 10/2003 | Droppo et al. |
| 2004/0213419 | A1 | 10/2004 | Varma et al. |
| 2004/0220800 | A1 | 11/2004 | Kong et al. |
| 2005/0069162 | A1 | 3/2005 | Haykin et al. |
| 2005/0143997 | A1 | 6/2005 | Huang et al. |
| 2005/0232445 | A1 | 10/2005 | Vaudrey et al. |
| 2006/0056647 | A1 | 3/2006 | Ramakrishnan et al. |
| 2006/0109988 | A1 | 5/2006 | Metcalf |
| 2006/0112811 | A1 | 6/2006 | Padhi et al. |
| 2007/0165871 | A1 | 7/2007 | Roovers et al. |
| 2007/0195975 | A1 | 8/2007 | Cotton et al. |
| 2007/0225932 | A1 | 9/2007 | Halford |
| 2008/0021703 | A1 | 1/2008 | Kawamura et al. |
| 2008/0019548 | A1 | 6/2008 | Avendano |
| 2008/0130924 | A1 | 6/2008 | Vaudrey et al. |
| 2008/0152235 | A1 | 6/2008 | Bashyam et al. |
| 2008/0167868 | A1 | 7/2008 | Kanevsky et al. |
| 2008/0232603 | A1 | 9/2008 | Soulodre |
| 2008/0288566 | A1 | 11/2008 | Umeno et al. |
| 2009/0003615 | A1 | 1/2009 | Roovers et al. |
| 2009/0006038 | A1 | 1/2009 | Jojic et al. |
| 2009/0080632 | A1 | 3/2009 | Zhang et al. |
| 2009/0086998 | A1 | 4/2009 | Jeong et al. |
| 2009/0094375 | A1 | 4/2009 | Lection |
| 2009/0128571 | A1 | 5/2009 | Smith et al. |
| 2009/0132245 | A1 | 5/2009 | Wilson et al. |
| 2009/0150146 | A1 | 6/2009 | Cho et al. |
| 2009/0231276 | A1 | 9/2009 | Ullrich et al. |
| 2009/0238377 | A1 | 9/2009 | Ramakrishnan et al. |
| 2010/0094643 | A1 | 4/2010 | Avendano et al. |
| 2010/0111313 | A1 | 5/2010 | Namba et al. |
| 2010/0138010 | A1 | 6/2010 | Aziz Sbai et al. |
| 2010/0174389 | A1 | 7/2010 | Blouet et al. |
| 2010/0180756 | A1 | 7/2010 | Fliegler et al. |
| 2010/0185439 | A1 | 7/2010 | Crockett |
| 2010/0202700 | A1 | 8/2010 | Rezazadeh et al. |
| 2010/0332222 | A1 | 12/2010 | Bai et al. |
| 2011/0058685 | A1 | 3/2011 | Sagayama et al. |
| 2011/0064242 | A1 | 3/2011 | Parikh |
| 2011/0078224 | A1 | 3/2011 | Wilson et al. |
| 2011/0194709 | A1 | 8/2011 | Ozerov et al. |
| 2011/0206223 | A1 | 8/2011 | Ojala |
| 2011/0255725 | A1 | 10/2011 | Faltys et al. |
| 2011/0261977 | A1 | 10/2011 | Hiroe |
| 2011/0264456 | A1 | 10/2011 | Koppens et al. |
| 2012/0101401 | A1 | 4/2012 | Faul et al. |
| 2012/0101826 | A1 | 4/2012 | Visser et al. |
| 2012/0128165 | A1 | 5/2012 | Visser et al. |
| 2012/0130716 | A1 | 5/2012 | Kim |
| 2012/0143604 | A1 | 6/2012 | Singh |
| 2012/0163513 | A1 | 6/2012 | Park et al. |
| 2012/0189140 | A1 | 7/2012 | Hughes |
| 2012/0207313 | A1 | 8/2012 | Ojanpera |
| 2012/0213376 | A1 | 8/2012 | Hellmuth et al. |
| 2012/0308015 | A1 | 12/2012 | Ramteke |
| 2013/0021431 | A1 | 1/2013 | Lemmey et al. |
| 2013/0070928 | A1 | 3/2013 | Ellis et al. |
| 2013/0132082 | A1 | 5/2013 | Smaragdis |
| 2013/0194431 | A1 | 8/2013 | O'Connor et al. |
| 2013/0230121 | A1 | 9/2013 | Molko et al. |
| 2013/0297296 | A1 | 11/2013 | Yoo et al. |
| 2013/0297298 | A1 | 11/2013 | Yoo et al. |
| 2014/0037110 | A1 | 2/2014 | Girin et al. |
| 2014/0201630 | A1 * | 7/2014 | Bryan ..... G10L 21/0272 715/716 |
| 2014/0218536 | A1 | 8/2014 | Anderson, Jr. et al. |
| 2014/0328487 | A1 | 11/2014 | Hiroe |
| 2014/0358534 | A1 | 12/2014 | Sun et al. |
| 2015/0077509 | A1 | 3/2015 | Ben Natan et al. |
| 2015/0181359 | A1 | 6/2015 | Kim et al. |
| 2015/0211079 | A1 | 7/2015 | Datta et al. |
| 2015/0221334 | A1 | 8/2015 | King et al. |
| 2015/0222951 | A1 | 8/2015 | Ramaswamy |
| 2015/0235555 | A1 | 8/2015 | Claudel |
| 2015/0235637 | A1 | 8/2015 | Casado et al. |
| 2015/0248891 | A1 | 9/2015 | Adami et al. |
| 2015/0264505 | A1 | 9/2015 | Tsilfidis et al. |
| 2015/0317983 | A1 | 11/2015 | Tsilfidis et al. |
| 2016/0064006 | A1 | 3/2016 | Disch et al. |
| 2016/0065898 | A1 | 3/2016 | Lee |
| 2017/0171681 | A1 | 6/2017 | Tsilfidis et al. |
| 2018/0176705 | A1 | 6/2018 | Tsilfidis et al. |
| 2020/0075030 | A1 | 3/2020 | Tsilfidis et al. |

OTHER PUBLICATIONS

Frederic, John "Examination of Initialization of Techniques for Nonnegative Matrix Factorization" Georgia State University Digital Archive @ GSU; Department of Mathematics and Statistics, Mathematics Theses; Nov. 21, 2008.

Guy-Bart, Stan et al. "Comparison of Different Impulse Response Measurement Techniques" Sound and Image Department, University of Liege, Institute Montefiore B28, Sart Tilman, B-4000 Liege 1 Belgium, Dec. 2002.

Huang, Y.A., et al. "Acoustic MIMO Signal Processing; Chapters—Blind Identification of Acoustic MIMO systems" Springer US, 2006, pp. 109-167.

Pedersen, Michael Syskind et al. "Two-Microphone Separation of Speech Mixtures" IEEE Transactions on Neural Networks, vol. 10, No. 3, Mar. 2008.

Schmidt, Mikkel et al. "Single-Channel Speech Separation Using Sparse Non-Negative Matrix Factorization" Informatics and Mathematical Modelling, Technical University of Denmark, Proceedings of Interspeech, pp. 2614-2617 (2006).

Vincent, Emmanuel et al. "Adaptive Harmonic Spectral Decomposition for Multiple Pitch Estimation" IEEE Transactions on Audio, Speech, and Language Processing, vol. 18. No. 3, Mar. 2010.

Wilson, Kevin et al. "Speech Denoising Using Nonnegative Matrix Factorization with Priors" Mitsubishi Electric Research Laboratories; IEEE International Conference on Acoustics, Speech and Signal Processing, pp. 4029-4032; Aug. 2008.

European Search Report for European Patent Application No. 15001261.5, dated Sep. 8, 2015.

Office Action for U.S. Appl. No. 14/011,981, dated May 5, 2015.

Office Action for U.S. Appl. No. 14/011,981, dated Jan. 7, 2016.

Office Action for U.S. Appl. No. 14/011,981, dated Jul. 28, 2016.

Office Action for U.S. Appl. No. 14/011,981, dated Feb. 24, 2017.

Advisory Action for U.S. Appl. No. 14/011,981, dated Aug. 10, 2017.

Notice of Allowance for U.S. Appl. No. 14/011,981, dated Sep. 12, 2017.

Notice of Allowance for U.S. Appl. No. 15/804,675, dated Mar. 20, 2019.

Office Action for U.S. Appl. No. 16/521,844, dated Jan. 28, 2021.

Office Action for U.S. Appl. No. 16/521,844, dated Jun. 4, 2021.

Notice of Allowance for U.S. Appl. No. 16/521,844, dated Sep. 27, 2021.

Office Action for U.S. Appl. No. 14/645,713 dated Apr. 21, 2016.

Notice of Allowance for U.S. Appl. No. 15/218,884 dated Dec. 22, 2016.

Office Action for U.S. Appl. No. 15/443,441 dated Apr. 6, 2017.

Notice of Allowance for U.S. Appl. No. 15/443,441 dated Oct. 26, 2017.

Office Action for U.S. Appl. No. 15/899,030 dated Mar. 27, 2018.

(56) References Cited

OTHER PUBLICATIONS

Office Action for U.S. Appl. No. 15/899,030 dated Jan. 25, 2019.
Office Action for U.S. Appl. No. 14/265,560 dated Nov. 3, 2015.
Office Action for U.S. Appl. No. 14/265,560 dated May 9, 2016.
Office Action for U.S. Appl. No. 14/265,560 dated May 17, 2017.
Office Action for U.S. Appl. No. 14/265,560 dated Nov. 30, 2017.
Advisory Action for U.S. Appl. No. 14/265,560 dated May 17, 2018.
Non-Final Office Action for U.S. Appl. No. 14/265,560 dated Nov. 2, 2018.
Notice of Allowance for U.S. Appl. No. 14/265,560 dated Jun. 13, 2019.
Non-Final Office Action for U.S. Appl. No. 16/674,135 dated Aug. 27, 2021.
U.S. Appl. No. 14/011,981, filed Aug. 28, 2013 U.S. Pat. No. 9,812,150.
U.S. Appl. No. 15/804,675, filed Nov. 6, 2017 U.S. Pat. No. 10,366,705.
U.S. Appl. No. 16/521,844, filed Jul. 25, 2019 U.S. Pat. No. 11,238,881.
U.S. Appl. No. 14/645,713, filed May 12, 2015.
U.S. Appl. No. 15/218,884, filed Jul. 25, 2016 U.S. Pat. No. 9,584,940.
U.S. Appl. No. 15/443,441, filed Feb. 27, 2017 U.S. Pat. No. 9,918,174.
U.S. Appl. No. 15/899,030, filed Feb. 19, 2018.
U.S. Appl. No. 14/265,560, filed Apr. 30, 2014 U.S. Pat. No. 10,468,036.
U.S. Appl. No. 16/674,135, filed Nov. 5, 2019.

* cited by examiner

METHODS AND SYSTEMS FOR IMPROVED SIGNAL DECOMPOSITION

CROSS REFERENCE TO RELATED APPLICATIONS

This application is a Continuation of U.S. patent application Ser. No. 16/521,844, filed Jul. 25, 2019, now U.S. Pat. No. 11,238,881, which is a Continuation of U.S. patent application Ser. No. 15/804,675, filed Nov. 6, 2017, now U.S. Pat. No. 10,366,705, which is a Continuation of U.S. patent application Ser. No. 14/011,981, filed Aug. 28, 2013, now U.S. Pat. No. 9,812,150, each of which are incorporated herein by reference in their entirety.

TECHNICAL FIELD

Various embodiments of the present application relate to decomposing digital signals in parts and combining some or all of said parts to perform any type of processing, such as source separation, signal restoration, signal enhancement, noise removal, un-mixing, up-mixing, re-mixing, etc. Aspects of the invention relate to all fields of signal processing including but not limited to speech, audio and image processing, radar processing, biomedical signal processing, medical imaging, communications, multimedia processing, forensics, machine learning, data mining, etc.

BACKGROUND

In signal processing applications, it is commonplace to decompose a signal into parts or components and use all or a subset of these components in order to perform one or more operations on the original signal. In other words, decomposition techniques extract components from signals or signal mixtures. Then, some or all of the components can be combined in order to produce desired output signals. Factorization can be considered as a subset of the general decomposition framework and generally refers to the decomposition of a first signal into a product of other signals, which when multiplied together represent the first signal or an approximation of the first signal.

Signal decomposition is often required for signal processing tasks including but not limited to source separation, signal restoration, signal enhancement, noise removal, un-mixing, up-mixing, re-mixing, etc. As a result, successful signal decomposition may dramatically improve the performance of several processing applications. Therefore, there is a great need for new and improved signal decomposition methods and systems.

Since signal decomposition is often used to perform processing tasks by combining decomposed signal parts, there are many methods for automatic or user-assisted selection, categorization and/or sorting of said parts. By exploiting such selection, categorization and/or sorting procedures, an algorithm or a user can produce useful output signals. Therefore there is a need for new and improved selection, categorization and/or sorting techniques of decomposed signal parts. In addition there is a great need for methods that provide a human user with means of combining such decomposed signal parts.

Source separation is an exemplary technique that is mostly based on signal decomposition and requires the extraction of desired signals from a mixture of sources. Since the sources and the mixing processes are usually unknown, source separation is a major signal processing challenge and has received significant attention from the research community over the last decades. Due to the inherent complexity of the source separation task, a global solution to the source separation problem cannot be found and therefore there is a great need for new and improved source separation methods and systems.

A relatively recent development in source separation is the use of non-negative matrix factorization (NMF). The performance of NMF methods depends on the application field and also on the specific details of the problem under examination. In principle, NMF is a signal decomposition approach and it attempts to approximate a non-negative matrix V as a product of two non-negative matrices W (the basis matrix) and H (the weight matrix). To achieve said approximation, a distance or error function between V and WH is constructed and minimized. In some cases, the matrices W and H are randomly initialized. In other cases, to improve performance and ensure convergence to a meaningful and useful factorization, a training step can be employed (see for example Schmidt, M., & Olsson, R. (2006). "Single-Channel Speech Separation using Sparse Non-Negative Matrix Factorization", Proceedings of Interspeech, pp. 2614-2617 and Wilson, K. W., Raj, B., Smaragdis, P. & Divakaran, A. (2008), "Speech denoising using nonnegative matrix factorization with priors," IEEE International Conference on Acoustics, Speech and Signal Processing, pp. 4029-4032). Methods that include a training step are referred to as supervised or semi-supervised NMF. Such training methods typically search for an appropriate initialization of the matrix W, in the frequency domain. There is also, however, an opportunity to train in the time domain. In addition, conventional NMF methods typically initialize the matrix H with random signal values (see for example Frederic, J, "Examination of Initialization Techniques for Nonnegative Matrix Factorization" (2008). Mathematics Theses. Georgia State University). There is also an opportunity for initialization of H using multichannel information or energy ratios. Therefore, there is overall a great need for new and improved NMF training methods for decomposition tasks and an opportunity to improve initialization techniques using time domain and/or multichannel information and energy ratios.

Source separation techniques are particularly important for speech and music applications. In modern live sound reinforcement and recording, multiple sound sources are simultaneously active and their sound is captured by a number of microphones. Ideally each microphone should capture the sound of just one sound source. However, sound sources interfere with each other and it is not possible to capture just one sound source. Therefore, there is a great need for new and improved source separation techniques for speech and music applications.

SUMMARY

Aspects of the invention relate to training methods that employ training sequences for decomposition.

Aspects of the invention also relate to a training method that performs initialization of a weight matrix, taking into account multichannel information.

Aspects of the invention also relate to an automatic way of sorting decomposed signals.

Aspects of the invention also relate to a method of combining decomposed signals, taking into account input from a human user.

BRIEF DESCRIPTION OF THE DRAWINGS

For a more complete understanding of the invention, reference is made to the following description and accompanying drawings, in which.

DETAILED DESCRIPTION

Hereinafter, embodiments of the present invention will be described in detail in accordance with the references to the accompanying drawings. It is understood that other embodiments may be utilized and structural changes may be made without departing from the scope of the present application.

The exemplary systems and methods of this invention will sometimes be described in relation to audio systems. However, to avoid unnecessarily obscuring the present invention, the following description omits well-known structures and devices that may be shown in block diagram form or otherwise summarized.

For purposes of explanation, numerous details are set forth in order to provide a thorough understanding of the present invention. It should be appreciated however that the present invention may be practiced in a variety of ways beyond the specific details set forth herein. The terms determine, calculate and compute, and variations thereof, as used herein are used interchangeably and include any type of methodology, process, mathematical operation or technique.

Figure 1:
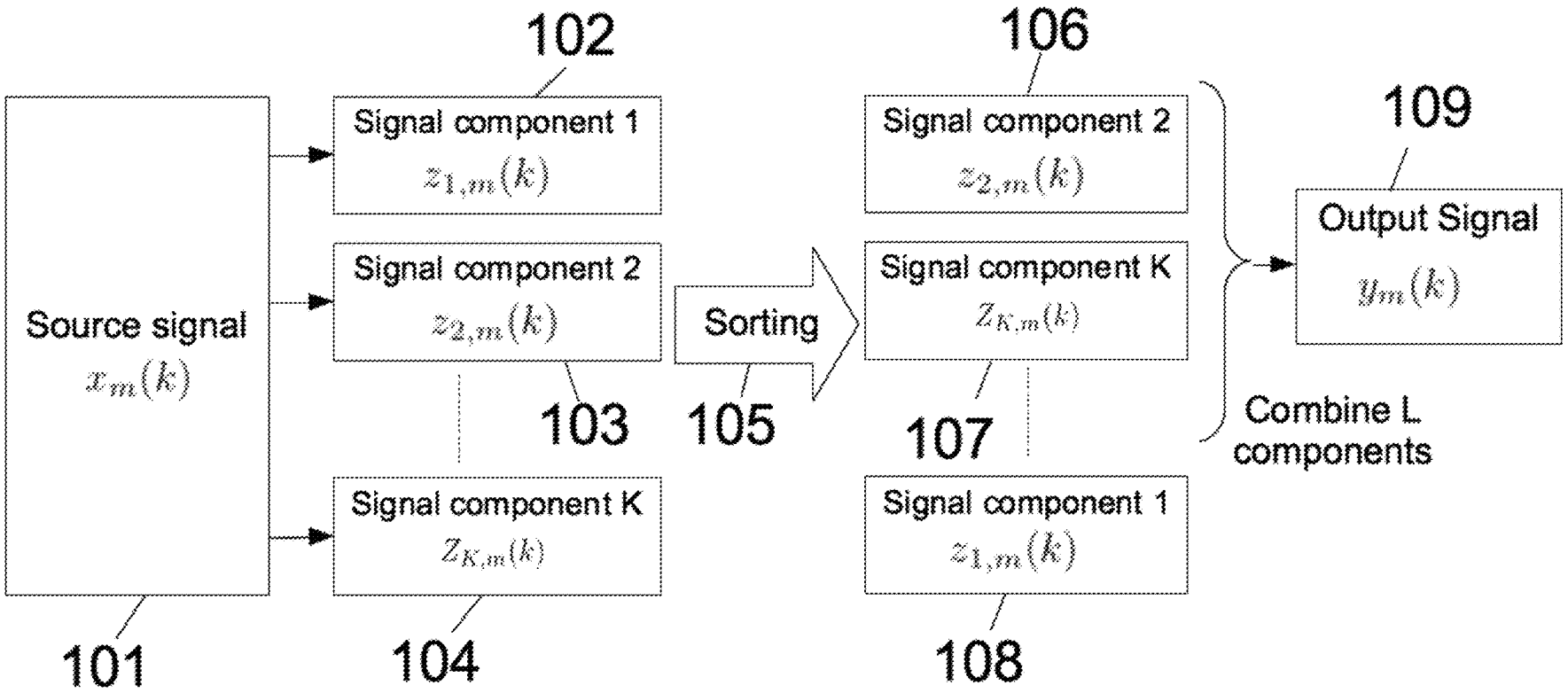
FIG. 1 illustrates an exemplary schematic representation of a processing method based on decomposition.

FIG. 1 illustrates an exemplary case of how a decomposition method can be used to apply any type of processing. A source signal 101 is decomposed in signal parts or components 102, 103 and 104. Said components are sorted 105, either automatically or manually from a human user. Therefore the original components are rearranged 106, 107, 108 according to the sorting process. Then a combination of some or all of these components forms any desired output 109. When for example said combination of components forms a single source coming from an original mixture of multiple sources, said procedure refers to a source separation technique. When for example residual components represent a form of noise, said procedure refers to a denoise technique. All embodiments of the present application may refer to a general decomposition procedure, including but not limited to non-negative matrix factorization, independent component analysis, principal component analysis, singular value decomposition, dependent component analysis, low-complexity coding and decoding, stationary subspace analysis, common spatial pattern, empirical mode decomposition, tensor decomposition, canonical polyadic decomposition, higher-order singular value decomposition, tucker decomposition, etc.

In an exemplary embodiment, a non-negative matrix factorization algorithm can be used to perform decomposition, such as the one described in FIG. 1. Consider a source signal $x_m(k)$, which can be any input signal and k is the sample index. In a particular embodiment, a source signal can be a mixture signal that consists of N simultaneously active signals $s_n(k)$. In particular embodiments, a source signal may always be considered a mixture of signals, either consisting of the intrinsic parts of the source signal or the source signal itself and random noise signals or any other combination thereof. In general, a source signal is considered herein as an instance of the source signal itself or one or more of the intrinsic parts of the source signal or a mixture of signals.

In an exemplary embodiment, the intrinsic parts of an image signal representing a human face could be the images of the eyes, the nose, the mouth, the ears, the hair etc. In another exemplary embodiment, the intrinsic parts of a drum snare sound signal could be the onset, the steady state and the tail of the sound. In another embodiment, the intrinsic parts of a drum snare sound signal could be the sound coming from each one of the drum parts, i.e. the hoop/rim, the drum head, the snare strainer, the shell etc. In general, intrinsic parts of a signal are not uniquely defined and depend on the specific application and can be used to represent any signal part.

Given the source signal $x_m(k)$, any available transform can be used in order to produce the non-negative matrix $V_m$. from the source signal. When for example the source signal is non-negative and two-dimensional, $V_m$ can be the source signal itself. When for example the source signal is in the time domain, the non-negative matrix $V_m$ can be derived through transformation in the time-frequency domain using any relevant technique including but not limited to a short-time Fourier transform (STFT), a wavelet transform, a polyphase filterbank, a multi rate filterbank, a quadrature mirror filterbank, a warped filterbank, an auditory-inspired filterbank, etc.

A non-negative matrix factorization algorithm typically consists of a set of update rules derived by minimizing a distance measure between $V_m$ and $W_mH_m$, which is sometimes formulated utilizing some underlying assumptions or modeling of the source signal. Such an algorithm may produce upon convergence a matrix product that approximates the original matrix $V_m$ as in equation (1).

$$V_m \approx \hat{V}_m - W_m H_m \tag{1}$$

The matrix $W_m$ has size F×K and the matrix $H_m$ has size K×T, where K is the rank of the approximation (or the number of components) and typically K<<FT. Each component may correspond to any kind of signal including but not limited to a source signal, a combination of source signals, a part of a source signal, a residual signal. After estimating the matrices $W_m$ and $H_m$, each F×1 column $w_{j,m}$ of the matrix $W_m$, can be combined with a corresponding 1×T row $h_{j,m}{}^T$ of matrix $H_m$ and thus a component mask $A_{j,m}$ can be obtained $$A_{j,m} = w_{j,m} h_{j,m}^T \tag{2}$$

When applied to the original matrix $V_m$, this mask may produce a component signal $z_{j,m}(k)$ that corresponds to parts or combinations of signals present in the source signal. There are many ways of applying the mask $A_{j,m}$ and they are all in the scope of the present invention. In a particular embodiment, the real-valued mask $A_{j,m}$ could be directly applied to the complex-valued matrix $X_m$, that may contain the time-frequency transformation of $x_m(k)$ as in (3).

$$Z_{j,m} = A_{j,\tau n} \circ X_m \tag{3}$$

where $\circ$ is the Hadamart product. In this embodiment, applying an inverse time-frequency transform on $Z_{j,m}$ produces the component signals $z_{j,m}(k)$.

In many applications, multiple source signals are present (i.e. multiple signals $x_m(k)$ with m=1, 2, . . . M) and therefore multichannel information is available. In order to exploit such multichannel information, non-negative tensor factorization (NTF) methods can be also applied (see Section 1.5 in A. Cichocki, R. Zdunek, A. H. Phan, S.-I. Amari, "Non-negative Matrix and Tensor Factorization: Applications to Exploratory Multi-way Data Analysis and Blind Source Separation", John Wiley & Sons, 2009). Alternatively, appropriate tensor unfolding methods (see Section 1.4.3 in A. Cichocki, R. Zdunek, A. H. Phan, S.-I. Amari, "Non-negative Matrix and Tensor Factorization: Applications to Exploratory Multi-way Data Analysis and Blind Source Separation", John Wiley & Sons, 2009) will transform the multichannel tensors to a matrix and enable the use of NMF methods. All of the above decomposition methods are in the scope of the present invention. In order to ensure the convergence of NMF to a meaningful factorization that can provide useful component signals, a number of training techniques have been proposed. In the context of NMF, training typically consists of estimating the values of matrix $W_m$, and it is sometimes referred to as supervised or semi-supervised NMF.

In an exemplary embodiment of the present application, a training scheme is applied based on the concept of training sequences. A training sequence $\hat{s}_m(k)$ is herein defined as a signal that is related to one or more of the source signals (including their intrinsic parts). For example, a training sequence can consist of a sequence of model signals $s'_{i,m}(k)$. A model signal may be any signal and a training sequence may consist of one or more model signals. In some embodiments, a model signal can be an instance of one or more of the source signals (such signals may be captured in isolation), a signal that is similar to an instance of one or more of source signals, any combination of signals similar to an instance of one or more of the source signals, etc. In the preceding, a source signal is considered the source signal itself or one or more of the intrinsic parts of the source signal. In specific embodiments, a training sequence contains model signals that approximate in some way the signal that we wish to extract from the source signal under processing. In particular embodiments, a model signal may be convolved with shaping filters $g_i(k)$ which may be designed to change and control the overall amplitude, amplitude envelope and spectral shape of the model signal or any combination of mathematical or physical properties of the model signal. The model signals may have a length of $L_t$ samples and there may be R model signals in a training sequence, making the length of the total training sequence equal to $L_tR$. In particular embodiments, the training sequence can be described as in equation (4):

$$\hat{s}_m(k) = \sum_{r=0}^{R-1} \left[g_1(k) * s'_{1,m}(k)\right] B(k; iL_t, iL_t + L_t - 1) \tag{4}$$

where B(x; a, b) is the boxcar function given by:

$$B(x; a_1, b) - \begin{cases} 0 & \text{if } x < a \text{ and } x > b \\ 1 & \text{if } a \le x \le b \end{cases} \tag{5}$$

In an exemplary embodiment, a new non-negative matrix $\hat{S}_m$ is created from the signal $\hat{s}_m(k)$ by applying the same time-frequency transformation as for $x_m(k)$ and is appended to $V_m$ as $$\overline{V}_m = \left[\hat{S}_m | V_m | \hat{S}_m\right] \tag{6}$$

In specific embodiments, a matrix $\hat{S}_m$ can be appended only on the left side or only on the right side or on both sides of the original matrix $V_m$, as shown in equation 6. This illustrates that the training sequence is combined with the source signal. In other embodiments, the matrix $V_m$ can be split in any number of sub-matrices and these sub-matrices can be combined with any number of matrices $\hat{S}_m$, forming an extended matrix $\overline{V}_m$. After this training step, any decomposition method of choice can be applied to the extended matrix $\overline{V}_m$. If multiple source signals are processed simultaneously in a NTF or tensor unfolded NMF scheme, the training sequences for each source signal may or may not overlap in time. In other embodiments, when for some signals a training sequence is not formulated, the matrix $V_m$ may be appended with zeros or a low amplitude noise signal with a predefined constant or any random signal or any other signal. Note that embodiments of the present application are relevant for any number of source signals and any number of desired output signals.

Figure 2:
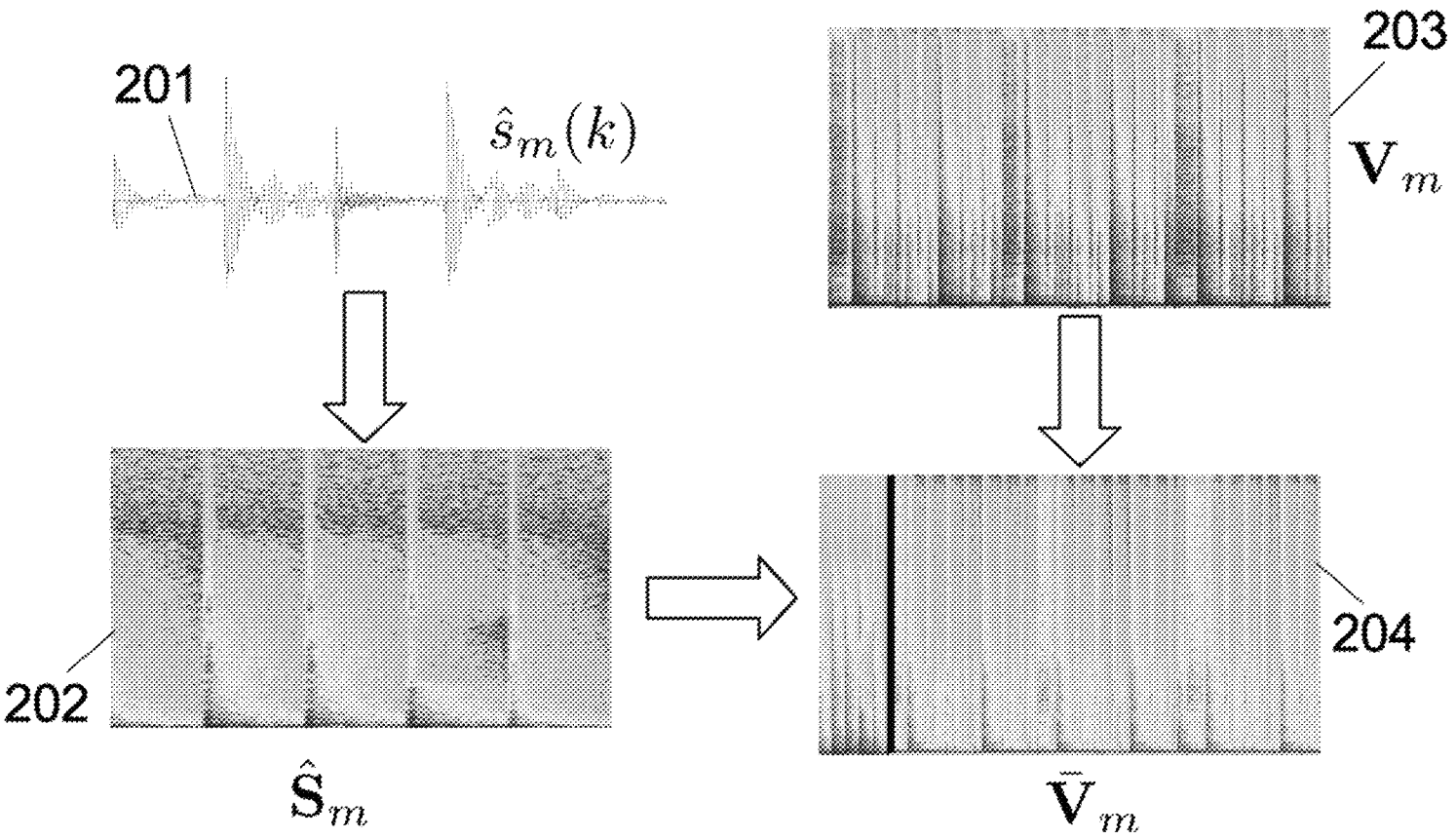
FIG. 2 illustrates an exemplary schematic representation of the creation of an extended spectrogram using a training sequence, in accordance with embodiments of the present invention.

An example illustration of a training sequence is presented in FIG. 2. In this example, a training sequence $\hat{s}_m(k)$ 201 is created and transformed to the time-frequency domain through a short-time Fourier transform to create a spectrogram $\hat{S}_m$ 202. Then, the spectrogram of the training sequence $\hat{S}_m$ is appended to the beginning of an original spectrogram $V_m$ 203, in order to create an extended spectrogram $\overline{V}_m$ 204. The extended spectrogram 204 can be used in order to perform decomposition (for example NMF), instead of the original spectrogram 203.

Another aspect that is typically overlooked in decomposition methods is the initialization of the weight matrix $H_m$. Typically this matrix can be initialized to random, non-negative values. However, by taking into account that in many applications, NMF methods operate in a multichannel environment, useful information can be extracted in order to initialize $H_m$ in a more meaningful way. In a particular embodiment, an energy ratio between a source signal and other source signals is defined and used for initialization of $H_m$.

When analyzing a source signal into frames of length $L_f$ with hop size $L_h$ and an analysis window w(k) we can express the κ-th frame as a vector $$x_m(k) = [x_m kL_h)w(0)x_m(kL_h + 1)w(1) \ldots x_m(kL_h + L_f - 1)w(L_f - 1)]^T \tag{7}$$

and the energy of the κ-th frame of the m-th source signal is given as $$\mathcal{E}[x_m(\kappa)] - \frac{1}{L_f}\lfloor x_m(\kappa)\rfloor^2 \tag{8}$$

The energy ratio for the m-th source signal is given by $$ER_m(\kappa) - \frac{\mathcal{E}[x_m(\kappa)]}{\sum_{\substack{i=1\\ i\neq m}}^{M}\mathcal{E}[x_m(\kappa)]} \tag{9}$$

The values of the energy ratio $ER_m(\kappa)$ can be arranged as a 1×T row vector and the M vectors can be arranged into an M×T matrix $\hat{H}_m$. If K=M then this matrix can be used as the initialization value of $H_m$. If K>M, this matrix can be appended with a (K−M)×T randomly initialized matrix or with any other relevant matrix. If K<M, only some of rows of $\hat{H}_m$ can be used.

In general, the energy ratio can be calculated from the original source signals as described earlier or from any modified version of the source signals. In another embodiment, the energy ratios can be calculated from filtered versions of the original signals. In this case bandpass filters may be used and they may be sharp and centered around a characteristic frequency of the main signal found in each source signal. This is especially useful in cases where such frequencies differ significantly for various source signals. One way to estimate a characteristic frequency of a source signal is to find a frequency bin with the maximum magnitude from an averaged spectrogram of the sources as in:

$$\omega_m^c - \underset{\omega}{\operatorname{argmax}}\left[\frac{1}{T}\sum_{n=1}^{T}|X_m(\kappa,\omega)|\right] \tag{10}$$

where ω is the frequency index. A bandpass filter can be designed and centered around $\omega_m^c$. The filter can be IIR, FIR, or any other type of filter and it can be designed using any digital filter design method. Each source signal can be filtered with the corresponding band pass filter and then the energy ratios can be calculated.

In other embodiments, the energy ratio can be calculated in any domain including but not limited to the time-domain for each frame κ, the frequency domain, the time-frequency domain, etc. In this case $ER_m(\kappa)$ can be given by $$ER_\omega(\kappa) - f(ER_m(\kappa,\omega)) \tag{11}$$

where f(·) is a suitable function that calculates a single value of the energy ratio for the κ-th frame by an appropriate combination of the values $ER_m(\kappa, \omega)$. In specific embodiments, said function could choose the value of $ER_m(\kappa, \omega_m^c)$ or the maximum value for all ω, or the mean value for all ω, etc. In other embodiments, the power ratio or other relevant metrics can be used instead of the energy ratio.

Figure 3:
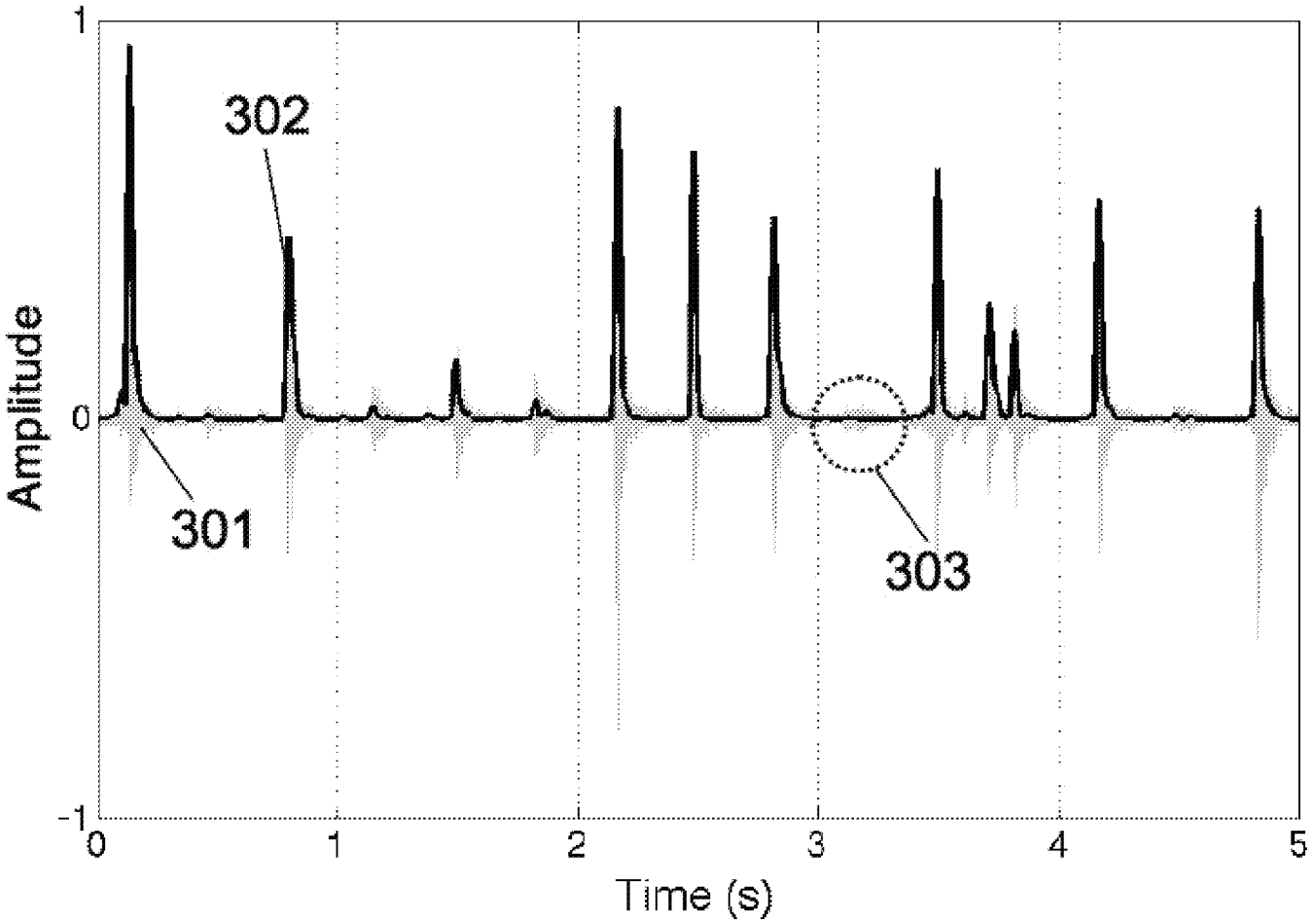
FIG. 3 illustrates an example of a source signal along with a function that is derived from an energy ratio, in accordance with embodiments of the present invention.

FIG. 3 presents an example where a source signal 301 and an energy ratio are each plotted as functions (amplitude vs. time) 302. The energy ratio has been calculated and is shown for a multichannel environment. The energy ratio often tracks the envelope of the source signal. In specific signal parts (for example signal position 303), however, the energy ratio has correctly identified an unwanted signal part and does not follow the envelope of the signal.

Figure 4:
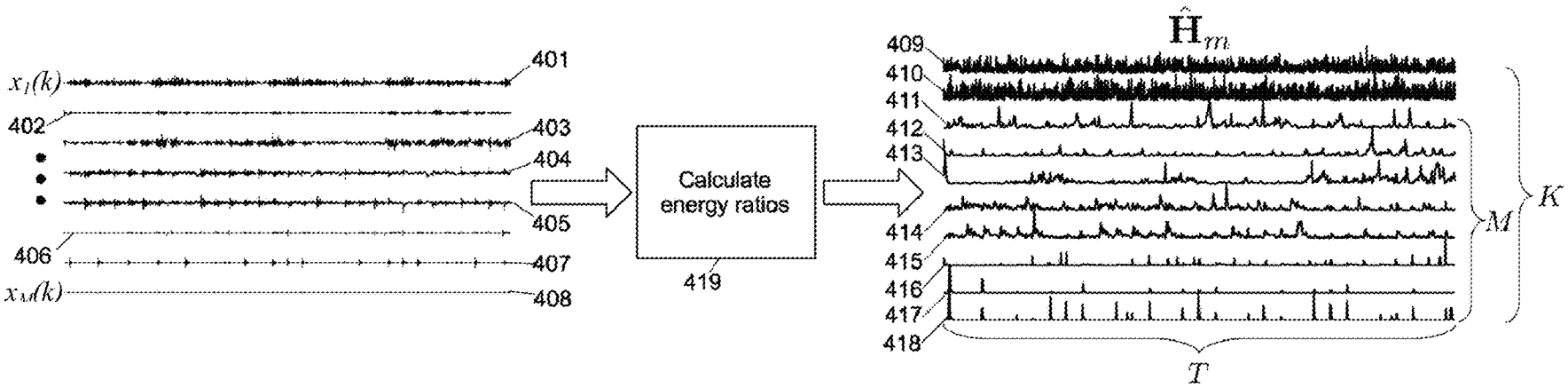
FIG. 4 illustrates an exemplary schematic representation of a set of source signals and a resulting initialization matrix in accordance with embodiments of the present invention.

FIG. 4 shows an exemplary embodiment of the present application where the energy ratio is calculated from M source signals $x_1(k)$ to $x_M(k)$ that can be analyzed in T frames and used to initialize a weight matrix $\hat{H}_m$ of K rows. In this specific embodiment there are 8 source signals 401, 402, 403, 404, 405, 406, 407 and 408. Using the 8 source signals the energy ratios are calculated 419 and used to initialize 8 rows of the matrix $\hat{H}_m$ 411, 412, 413, 414, 415, 416, 417 and 418. In this example, since the rows of matrix $\hat{H}_m$ are 10 (more than the source signals), the rows 409 and 410 are initialized with random signals.

Using the initialization and training steps described above, a meaningful convergence of the decomposition can be achieved. After convergence, the component masks are extracted and applied to the original matrix in order to produce a set of K component signals $z_{j,m}(k)$ for each source signal $x_m(k)$. In a particular embodiment, said component signals are automatically sorted according to their similarity to a reference signal $r_m(k)$. First, an appropriate reference signal $r_m(k)$ must be chosen which can be different according to the processing application and can be any signal including but not limited to the source signal itself (which also includes one or many of its inherent parts), a filtered version of the source signal, an estimate of the source signal, etc. Then the reference signal is analyzed in frames and we define the set $$\Omega_m = \{\kappa: \mathcal{E}[r_m(\kappa)] > E_r\} \tag{12}$$

which indicates the frames of the reference signal that have significant energy, that is their energy is above a threshold $E_T$. We calculate the cosine similarity measure $$c_{j,m}(\kappa) - \frac{r_m(\kappa)\cdot z_{j,m}(\kappa)}{\|r_m(\kappa)\|\|z_{j,m}(\kappa)\|},\ \kappa\in\Omega_m \text{ and } j-1,\ldots,K \tag{13}$$

and then calculate $$c'_{j,m} - f(c_{j,m}(\kappa)) \tag{14}$$

In particular embodiments, f(·) can be any suitable function such as max, mean, median, etc. The component signals $z_{j,m}(k)$ that are produced by the decomposition process can now be sorted according to a similarity measure, i.e. a function that measures the similarity between a subset of frames of $r_m(k)$ and $z_{j,m}(k)$. A specific similarity measure is shown in equation (13), however any function or relationship that compares the component signals to the reference signals can be used. An ordering or function applied to the similarity measure $c_{j,m}(k)$ then results in $\acute{c}_{j,m}$. A high value indicates significant similarity between $r_m(k)$ and $z_{j,m}(k)$ while a low value indicates the opposite. In particular embodiments, clustering techniques can be used instead of using a similarity measure, in order to group relevant components together, in such a way that components in the same group (called cluster) are more similar (in some sense or another) to each other than to those in other groups (clusters). In particular embodiment, any clustering technique can be applied to a subset of component frames (for example those that are bigger than a threshold $E_T$), including but not limited to connectivity based clustering (hierarchical clustering), centroid-based clustering, distribution-based clustering, density-based clustering, etc.

Figure 5:
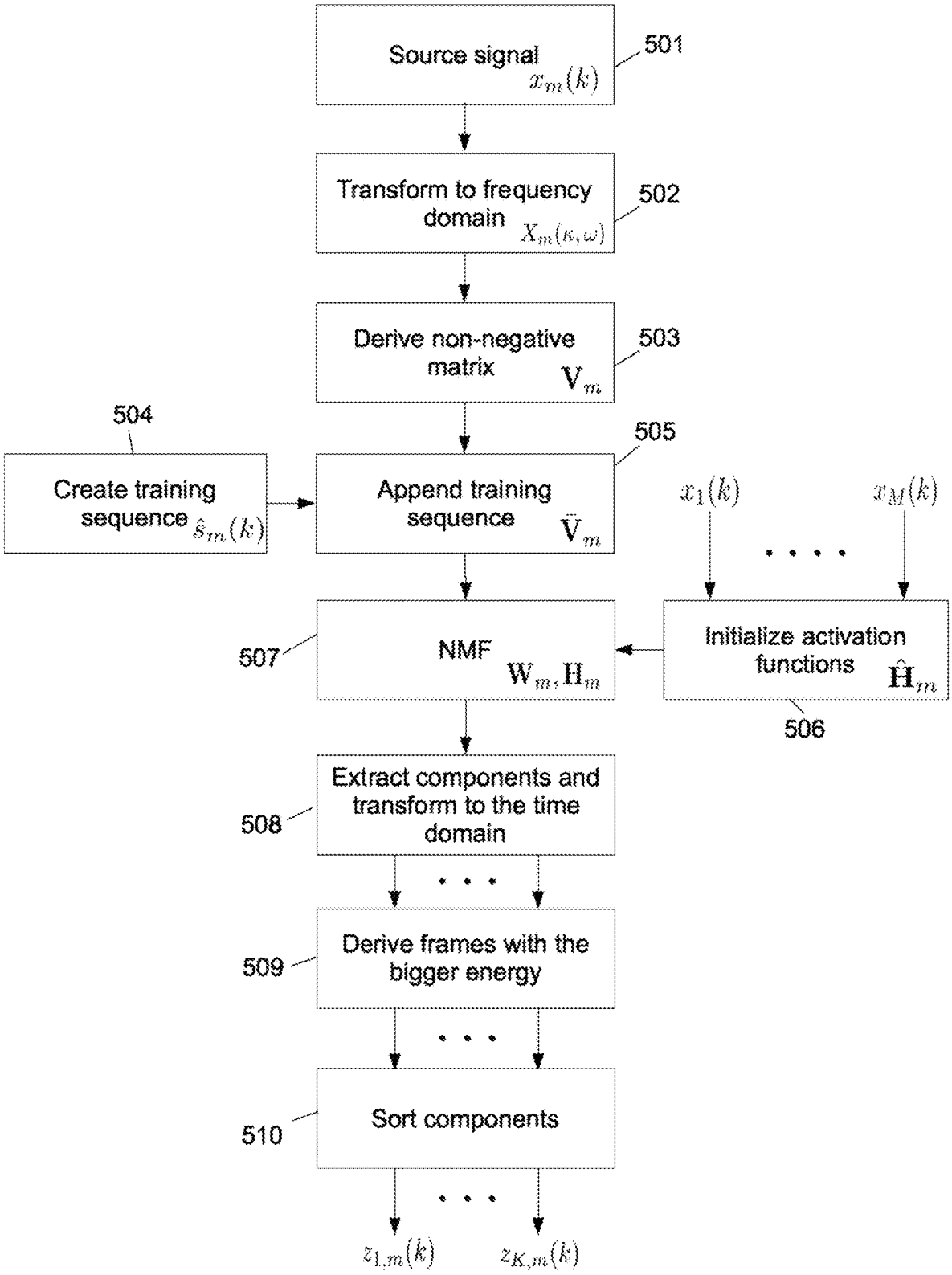
FIG. 5 illustrates an exemplary schematic representation of a block diagram showing a NMF decomposition method, in accordance with embodiments of the present invention.

FIG. 5 presents a block diagram where exemplary embodiments of the present application are shown. A time domain source signal 501 is transformed in the frequency 502 domain using any appropriate transform, in order to produce the non-negative matrix $V_m$ 503. Then a training sequence is created 504 and after any appropriate transform it is appended to the original non-negative matrix 505. In addition, the source signals are used to derive the energy ratios and initialize the weight matrix 506. Using the above initialized matrices, NMF is performed on $\bar{V}_m$ 507. After NMF, the signal components are extracted 508 and after calculating the energy of the frames, a subset of the frames with the biggest energy is derived 509 and used for the sorting procedure 510.

In particular embodiments, human input can be used in order to produce desired output signals. After automatic or manual sorting and/or categorization, signal components are typically in a meaningful order. Therefore, a human user can select which components from a predefined hierarchy will form the desired output. In a particular embodiment, K components are sorted using any sorting and/or categorization technique. A human user can define a gain μ for each one of the components. The user can define the gain explicitly or intuitively. The gain can take the value 0, therefore some components may not be selected. Any desired output $y_m(k)$ can be extracted as any combination of components $z_{j,m}(k)$:

$$y_m(k) = \sum_{i=1}^{K} \mu_j(k) z_{j,m}(k) \tag{15}$$

Figure 6:
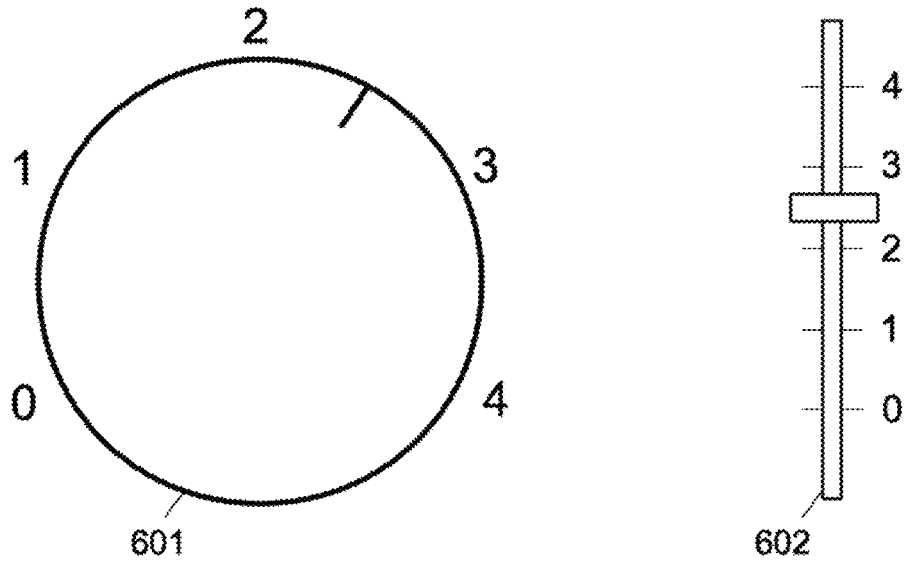
FIG. 6 illustrates an exemplary schematic representation of a user interface in accordance with embodiments of the present invention.

In FIG. 6 two exemplary user interfaces are illustrated, in accordance with embodiments of the present application, in the forms of a knob 601 and a slider 602. Such elements can be implemented either in hardware or in software.

In one particular example, the total number of components is 4. When the knob/slider is in position 0, the output will be zeroed, when it is in position 1 only the first component will be selected and when it is in position 4 all four components will be selected. When the user has set the value of the knob and/or slider at 2.5 and assuming that a simple linear addition is performed, the output will be given by:

$$y_m(k) = z_{1,m}(k) + z_{2,m}(k) + 0.5 z_{3,m}(k) \tag{16}$$

In another embodiment, a logarithmic addition can be performed or any other gain for each component can be derived from the user input.

Using similar interface elements, different mapping strategies regarding the component selection and mixture can be also followed. In another embodiment, in knob/slider position 0 of FIG. 6, the output will be the sum of all components, in position 1 components the output will be the sum of components 1, 2 and 3 and in position 4 the output will be zeroed. Therefore, assuming a linear addition scheme for this example, putting the knob/slider at position 2.5 will produce an output given by:

$$y_m(k) = z_{1,m}(k) + 0.5 z_{2,m}(k) \tag{17}$$

Again, the strategy and the gain for each component can be defined through any equation from the user-defined value of the slider/knob.

In another embodiment, source signals of the present invention can be microphone signals in audio applications. Consider N simultaneously active signals $s_n(k)$ (i.e. sound sources) and M microphones set to capture those signals, producing the source signals $x_m(k)$. In particular embodiments, each sound source signal may correspond to the sound of any type of musical instrument such as a multi-channel drums recording or human voice. Each source signal can be described as $$z_m(k) = \sum_{m=1}^{N} [\rho_s(k, \theta_{mm}) * z_m(k)] * [p_x(k, \theta_{mn}) * k_{mm}(k)] \tag{18}$$

for m=1, . . . , M. $\rho_s(k, \theta_{mn})$ is a filter that takes into account the source directivity, $\rho_c(k, \theta_{mn})$ is a filter that describes the microphone directivity, $h_{mn}(k)$ is the impulse response of the acoustic environment between the n-th sound source and m-th microphone and * denotes convolution.

In most audio applications each sound source is ideally captured by one corresponding microphone. However, in practice each microphone picks up the sound of the source of interest but also the sound of all other sources and hence equation (18) can be written as $$x_m(k) = [\rho_k(k, \theta_{mm}) * s_m(k)] * [\rho_c(k, \theta_{mm}) * h_{mm}(k)] + \sum_{\substack{n=1 \\ n \neq m}}^{N} [\rho_s(k, \theta_{mm}) * s_m(k)] * [\rho_c(k, \theta_{mm}) * h_{mm}(k)] \tag{19}$$

To simplify equation (19) we define the direct source signal as $$\hat{s}_m(k) = [\rho_s(k, \theta_{mm}) * s_m(k)] * [\rho_c(k, \theta_{mm}) * h_{mm}(k)] \tag{20}$$

Note that here m=n and the source signal is the one that should ideally be captured by the corresponding microphone. We also define the leakage source signal as $$\bar{s}_{nm}(k) = [\rho_s(k, \theta_{mm}) * s_m(k)] * [\rho_c(k, \theta_{mm}) * h_{mm}(k)] \tag{21}$$

In this case m≠n and the source signal is the result of a source that does not correspond to this microphone and ideally should not be captured. Using equations (20) and (21), equation (19) can be written as $$x_m(k) = \hat{s}_m(k) + \sum_{\substack{n=1 \\ n \neq m}}^{N} \bar{s}_{n,m}(k) \tag{22}$$

There are a number of audio applications that would greatly benefit from a signal processing method that would extract the direct source signal $\tilde{s}_m(k)$ the source signal $x_m(k)$ and remove the interfering leakage sources $\bar{s}_{n,m}(k)$.

One way to achieve this is to perform NMF on an appropriate representation of $x_m(k)$ according to embodiments of the present application. When the original mixture is captured in the time domain, the non-negative matrix $V_m$ can be derived through any signal transformation. For example, the signal can be transformed in the time-frequency domain using any relevant technique such as a short-time Fourier transform (STFT), a wavelet transform, a polyphase filterbank, a multi rate filterbank, a quadrature mirror filterbank, a warped filterbank, an auditory-inspired filterbank, etc. Each one of the above transforms will result in a specific time-frequency resolution that will change the processing accordingly. All embodiments of the present application can use any available time-frequency transform or any other transform that ensures a non-negative matrix $V_m$.

By appropriately transforming $x_m(k)$, the signal $X_m(\kappa, \omega)$ can be obtained where $\kappa=0, \ldots, T-1$ is the frame index and $\omega=0, \ldots, F-1$ is the discrete frequency bin index. From the complex-valued signal $X_m(\kappa, \omega)$ we can obtain the magnitude $V_m(\kappa, \omega)$. The values of $V_m(\kappa, \omega)$ form the magnitude spectrogram of the time-domain signal $x_m(k)$. This spectrogram can be arranged as a matrix $V_m$ of size $F \times T$. Note that where the term spectrogram is used, it does not only refer to the magnitude spectrogram but any version of the spectrogram that can be derived from $$V_m(\kappa, \omega) - f(|X_m(\kappa, \omega)|^2) \tag{23}$$

where $f(\cdot)$ can be any suitable function (for example the logarithm function). As seen from the previous analysis, all embodiments of the present application are relevant to sound processing in single or multichannel scenarios.

While the above-described flowcharts have been discussed in relation to a particular sequence of events, it should be appreciated that changes to this sequence can occur without materially effecting the operation of the invention. Additionally, the exemplary techniques illustrated herein are not limited to the specifically illustrated embodiments but can also be utilized and combined with the other exemplary embodiments and each described feature is individually and separately claimable.

Additionally, the systems, methods and protocols of this invention can be implemented on a special purpose computer, a programmed micro-processor or microcontroller and peripheral integrated circuit element(s), an ASIC or other integrated circuit, a digital signal processor, a hardwired electronic or logic circuit such as discrete element circuit, a programmable logic device such as PLD, PLA, FPGA, PAL, a modem, a transmitter/receiver, any comparable means, or the like. In general, any device capable of implementing a state machine that is in turn capable of implementing the methodology illustrated herein can be used to implement the various communication methods, protocols and techniques according to this invention.

Furthermore, the disclosed methods may be readily implemented in software using object or object-oriented software development environments that provide portable source code that can be used on a variety of computer or workstation platforms. Alternatively the disclosed methods may be readily implemented in software on an embedded processor, a micro-processor or a digital signal processor. The implementation may utilize either fixed-point or floating point operations or both. In the case of fixed point operations, approximations may be used for certain mathematical operations such as logarithms, exponentials, etc. Alternatively, the disclosed system may be implemented partially or fully in hardware using standard logic circuits or VLSI design. Whether software or hardware is used to implement the systems in accordance with this invention is dependent on the speed and/or efficiency requirements of the system, the particular function, and the particular software or hardware systems or microprocessor or microcomputer systems being utilized. The systems and methods illustrated herein can be readily implemented in hardware and/or software using any known or later developed systems or structures, devices and/or software by those of ordinary skill in the applicable art from the functional description provided herein and with a general basic knowledge of the audio processing arts.

Moreover, the disclosed methods may be readily implemented in software that can be stored on a storage medium, executed on programmed general-purpose computer with the cooperation of a controller and memory, a special purpose computer, a microprocessor, or the like. In these instances, the systems and methods of this invention can be implemented as program embedded on personal computer such as an applet, JAVA®. or CGI script, as a resource residing on a server or computer workstation, as a routine embedded in a dedicated system or system component, or the like. The system can also be implemented by physically incorporating the system and/or method into a software and/or hardware system, such as the hardware and software systems of an electronic device.

It is therefore apparent that there has been provided, in accordance with the present invention, systems and methods for improved signal decomposition in electronic devices. While this invention has been described in conjunction with a number of embodiments, it is evident that many alternatives, modifications and variations would be or are apparent to those of ordinary skill in the applicable arts. Accordingly, it is intended to embrace all such alternatives, modifications, equivalents and variations that are within the spirit and scope of this invention.

What is claimed is:

1. An apparatus capable of creating an initial set of values in a row of a weight matrix in non-negative matrix factorization to decompose digital signals, the apparatus capable of:

generating the initial set of values of the row of the weight matrix from a ratio of a first function of a first signal of a plurality of digital audio signals divided by a second function of at least two other signals of the plurality of the digital audio signals, wherein the row in the weight matrix determines a decomposition of the plurality of digital audio signals into signal components; and audibly outputting a portion of one or more of the components of the decomposed plurality of digital audio signals at least based on input from an interface element.

2. The apparatus of claim 1, wherein the digital audio signals are one or more of binaural or multichannel audio signals.

3. The apparatus of claim 1, wherein the first and second functions are calculated from one or more filtered versions of said digital audio signals.

4. The apparatus of claim 1, wherein the first and second functions are calculated in one or more of the time domain, the frequency domain, theme-frequency domain.

5. The apparatus of claim 1, wherein the first and second functions are calculated using one or more of energy, power, root mean square, geometric mean, arithmetic mean, euclidean norm, taxicab norm, or Lp norm.

6. The apparatus of claim 1, wherein the digital audio signals are one or more of binaural or multichannel audio signals and the output portion of the one or more of the components are used for one or more of: source separation, signal restoration, signal enhancement, noise removal, un-mixing, up-mixing and re-mixing.

7. The apparatus of claim 1, wherein the output portion of the one or more of the components are used for one or more of: source separation, signal restoration, signal enhancement, noise removal, un-mixing, up-mixing and re-mixing.

8. The apparatus of claim 1, wherein the plurality of digital signals are a single source coming from an original mixture of multiple sources.

9. The apparatus of claim 1, further comprising automatically sorting one or more of the components.

10. A non-transitory computer readable information storage media having stored therein instructions, that when executed by one or more processors, cause to be performed a method of creating an initial set of values in a row of a weight matrix in non-negative matrix factorization to decompose digital signals, the method comprising:

generating the initial set of values of the row of the weight matrix from a ratio of a first function of a first signal of a plurality of digital audio signals divided by a second function of at least two other signals of the plurality of the digital audio signals, wherein the row in the weight matrix determines a decomposition of the plurality of digital audio signals into signal components; and audibly outputting a portion of one or more of the components of the decomposed plurality of digital audio signals at least based on input from an interface element.

11. The media of claim 10, wherein the digital audio signals are one or more of binaural or multichannel audio signals.

12. The media of claim 10, wherein the first and second functions are calculated from one or more filtered versions of said digital audio signals.

13. The media of claim 10, wherein the first and second functions are calculated in one or more of the time domain, the frequency domain, theme-frequency domain.

14. The media of claim 10, wherein the first and second functions are calculated using one or more of energy, power, root mean square, geometric mean, arithmetic mean, euclidean norm, taxicab norm, or Lp norm.

15. The media of claim 10, wherein the digital audio signals are one or more of binaural or multichannel audio signals and the output portion of the one or more of the components are used for one or more of: source separation, signal restoration, signal enhancement, noise removal, un-mixing, up-mixing and re-mixing.

16. The media of claim 10, wherein the output portion of the one or more of the components are used for one or more of: source separation, signal restoration, signal enhancement, noise removal, un-mixing, up-mixing and re-mixing.

17. The media of claim 10, wherein the plurality of digital signals are a single source coming from an original mixture of multiple sources.

18. The media of claim 10, further comprising automatically sorting one or more of the components.

19. An apparatus capable of creating an initial set of values in a row of a weight matrix in non-negative matrix factorization to decompose digital signals, the apparatus comprising:

means for generating the initial set of values of the row of the weight matrix from a ratio of a first function of a first signal of a plurality of digital audio signals divided by a second function of at least two other signals of the plurality of the digital audio signals, wherein the row in the weight matrix determines a decomposition of the plurality of digital audio signals into signal components; and means for audibly outputting a portion of one or more of the components of the decomposed plurality of digital audio signals at least based on input from an interface element.

* * * * *